US007604168B2

(12) United States Patent
Eun et al.

(10) Patent No.: US 7,604,168 B2
(45) Date of Patent: Oct. 20, 2009

(54) APPARATUS FOR TRANSMITTING/RECEIVING DESTINATION WAKE-UP INFORMATION THROUGH COMMUNICATION SATELLITE NETWORK

(75) Inventors: Jong-Won Eun, Daejon (KR); Cheol-Oh Jeong, Daejon (KR); Seong-Pal Lee, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 476 days.

(21) Appl. No.: 11/008,065

(22) Filed: Dec. 8, 2004

(65) Prior Publication Data

US 2005/0121516 A1 Jun. 9, 2005

(30) Foreign Application Priority Data

Dec. 9, 2003 (KR) ..... 10-2003-0088944

(51) Int. Cl.
*G07B 15/02* (2006.01)

(52) U.S. Cl. ..... 235/384; 340/994; 340/575; 701/213

(58) Field of Classification Search ..... 235/381, 235/384, 61 NV, 61 S; 455/345; 340/901, 340/988, 994, 575; 246/122 R–122 A; 701/200, 701/207, 213–216

See application file for complete search history.

(56) References Cited

U.S. PATENT DOCUMENTS

| | | | | |
|---|---|---|---|---|
| 5,808,565 | A * | 9/1998 | Matta et al. | 340/994 |
| 6,072,785 | A * | 6/2000 | Ho | 370/320 |
| 6,707,570 | B1 * | 3/2004 | Gotanda et al. | 358/1.15 |
| 6,946,965 | B2 * | 9/2005 | Young et al. | 340/575 |
| 2006/0009905 | A1 * | 1/2006 | Soderberg et al. | 701/200 |
| 2006/0277078 | A1 * | 12/2006 | Ohmori et al. | 705/5 |

FOREIGN PATENT DOCUMENTS

| | | | |
|---|---|---|---|
| GB | 2352128 | A * | 1/2001 |
| KR | 1999-0068664 | | 9/1999 |
| KR | 2000-0030482 | | 6/2000 |
| KR | 20-0216176 | | 3/2001 |
| KR | 1020040069020 | | 8/2004 |

OTHER PUBLICATIONS

English machine translation of publication No. KR 10-1999-0068664, publication date: Sep. 6, 1999, all pages.*

Derwent publication of publication No. JP 09-301125A, Kongo Light Kogyo, published Nov. 25, 1997, all pages.*

(Continued)

*Primary Examiner*—Michael G Lee
*Assistant Examiner*—Rafferty Kelly
(74) *Attorney, Agent, or Firm*—Blakely Sokoloff Taylor & Zafman

(57) ABSTRACT

An apparatus for transmitting/receiving destination wake-up information through communication satellite network is disclosed. The apparatus includes: an input/output unit for receiving ticketing data from an external device, transmitting the ticketing data to a storing unit and outputting the ticketing data to a baseband processing unit by reading from the storing unit according to transmission conditions; a storing unit for storing the ticketing data based on a control of the controlling unit; a baseband processing unit for converting the ticketing data into a baseband signal; and a wireless transceiving unit for converting the baseband signal into a wireless signal and emitting the wireless signal through a satellite antenna.

3 Claims, 4 Drawing Sheets

OTHER PUBLICATIONS

Publication relating to JP 08-332955 A, Hosoda, includeing Derwent publication, published Dec. 17, 1996, all pages; English Abstract of JP 08-332955; English Machine translation of JP 08-332955.*

G. Mintsis, et al. "Applications of GPS Technology in the Land Transportation System", European Journal of Operational Research, No. 152, pp. 399-409, Jan. 16, 2004.

* cited by examiner

APPARATUS FOR TRANSMITTING/RECEIVING DESTINATION WAKE-UP INFORMATION THROUGH COMMUNICATION SATELLITE NETWORK

FIELD OF THE INVENTION

The present invention relates to an apparatus for transmitting/receiving destination wake-up information through a satellite communication network; and, more particularly, to an apparatus for transmitting/receiving destination wake-up information through a satellite communication network wherein a base station communication system transmits ticketing data that can be obtained by a transportation application such as a train and a bus, and a transportation communication system receives the ticketing data and navigation data including position information through a satellite communication network, to thereby operate a destination wake-up apparatus built in a seat of which destination is near, in order to inform a passenger arrival at the destination.

DESCRIPTION OF RELATED ART

In general, a passenger of a train or a bus often passes the destination because the passenger sleeps during a travel.

A conventional method is disclosed in Korean laid-open No. 2000-30482 filed by to D. H. Kim, entitled "Arrival Alarm on the Destination and Position information Apparatus".

Kim discloses a method for generating an arrival alarm signal through a terminal that stores destination information in advance by a user in order to inform arrival of destination when a user travels using a public transportation such as a bus and a subway.

However, the conventional method has a drawback that the user should input destination information into a terminal in advance.

SUMMARY OF THE INVENTION

It is, therefore, an object of the present invention to provide an apparatus for transmitting destination wake-up information using in order to inform a passenger of arrival at a destination, wherein a base station communication system transmits ticketing data that can be obtained by a transportation application such as a train and a bus through the satellite communication network.

It is, another object of the present invention to provide an apparatus for receiving destination wake-up information using a communication satellite network in order to inform a passenger of arrival at a destination, wherein a transportation communication system receives the ticketing data from the base station communication system and navigation data including position information through the satellite communication network to thereby operate a destination wake-up apparatus built in a seat of which destination is near.

In accordance with an aspect of the present invention, there is provided an apparatus for transmitting destination wake-up information using a satellite communication network, the apparatus comprising: an input/output unit for receiving ticketing data from an external device, transmitting the ticketing data to a storing unit and outputting the ticketing data to a baseband processing unit by reading from the storing unit according to transmission conditions; a storing unit for storing the ticketing data based on a control of the controlling unit; a baseband processing unit for converting the ticketing data into a baseband signal; and a wireless transceiving unit for converting the baseband signal into a wireless signal and emitting the wireless signal through a satellite antenna.

In accordance with another aspect of the present invention, there is provided an apparatus for receiving destination wake-up information using a satellite communication network, the apparatus comprising: a wireless transceiving unit for receiving a wireless signal from an apparatus for transmitting destination wake-up information through a communication satellite and a wireless signal including navigation data from a navigation satellite, converting the wireless signals into baseband signals and transmitting the baseband signal to a baseband processing unit; a baseband processing unit for receiving the baseband signal, converting the baseband signal into ticketing data or the navigation data and transmitting the ticketing data or the navigation data to a controlling unit; a controlling unit for receiving and storing the ticketing data from the baseband processing unit, selecting a target seat to be informed destination wake-up information by comparing position information extracted from the navigation data to the ticketing data stored in the storing unit and informing that destination is almost arrived seat by operating a destination wake-up apparatus; a storing unit for storing the ticketing data according to a control of the controlling unit; and a destination wake-up unit for outputting a destination wake-up signal according to a control of the controlling unit.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Hereinafter, an apparatus for transmitting/receiving destination wake-up information will be described in detail with reference to the accompanying drawings.

Figure 1:
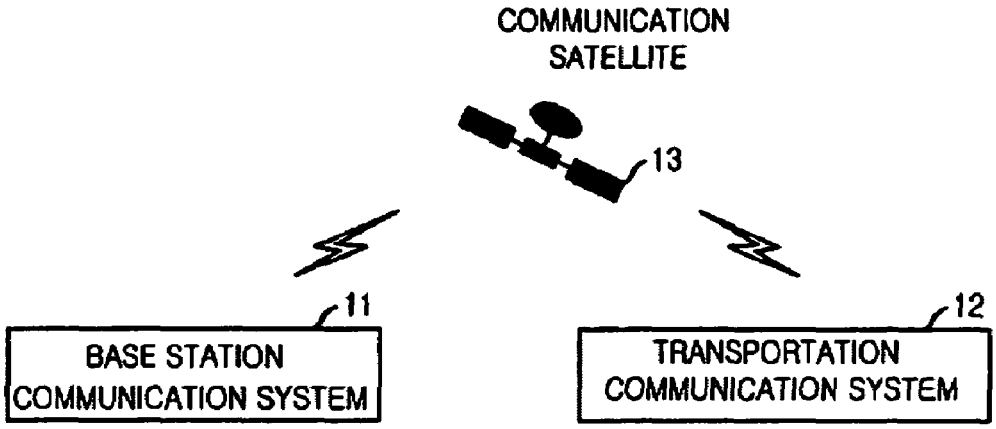
FIG. 1 is a block diagram showing a destination wake-up system using a satellite communication network in accordance with a preferred embodiment of the present invention.

FIG. 1 is a block diagram showing a destination wake-up system using a satellite communication network in accordance with a preferred embodiment of the present invention.

The destination wake-up system includes a base station communication system 11, a transportation communication system 12 and a communication satellite 13.

The base station communication system 11, which will be referred to as a destination wake-up information transmitter hereinafter, transmits ticketing data received from an outside, e.g., a ticket reservation, ticketing server to the transportation communication system 12, which will be referred to as a destination wake-up information receiver hereinafter. The destination wake-up information receiver 12 receives the ticketing data from the destination wake-up information transmitter 11 through the communication satellite 13 and stores it. Then, the destination wake-up information receiver 12 detects a relevant seat to be informed arrival of the destination based on position information extracted from navigation data transmitted from a navigation satellite, and informs the arrival of the destination by operating a destination wake-up apparatus built in the determined seat.

The destination wake-up information receiver 12 transmits passenger get-off information to the destination wake-up information transmitter 11 through the communication satellite 13, so that the passenger get-off information is stored in the destination wake-up information transmitter 11.

Meanwhile, the communication satellite 13 is a satellite operating as a space radio-wave repeater by rounding an orbit of the earth. the communication satellite 13 receives a signal from a terrestrial communication station, amplifies the received signal and retransmits the amplified signal to another earth station. Also, Global Positioning System (GPS) which is one of technologies using a satellite having a navigation function, i.e., a navigation satellite, is widely applied in various science fields.

The communication satellite 13 of the present invention makes the destination wake-up information transmitter 11 and the destination wake-up information receiver 12 exchange the ticketing data and the passenger get-off information in wireless. In particular, the destination wake-up information receiver 12 includes a function of a GPS receiver for extracting position information from the navigation data transmitted from the navigation satellite.

Detail operations of the destination wake-up information transmitter 11 and the destination wake-up information receiver 12 will be described with reference to FIG. 2 and FIG. 3 respectively.

Figure 2:
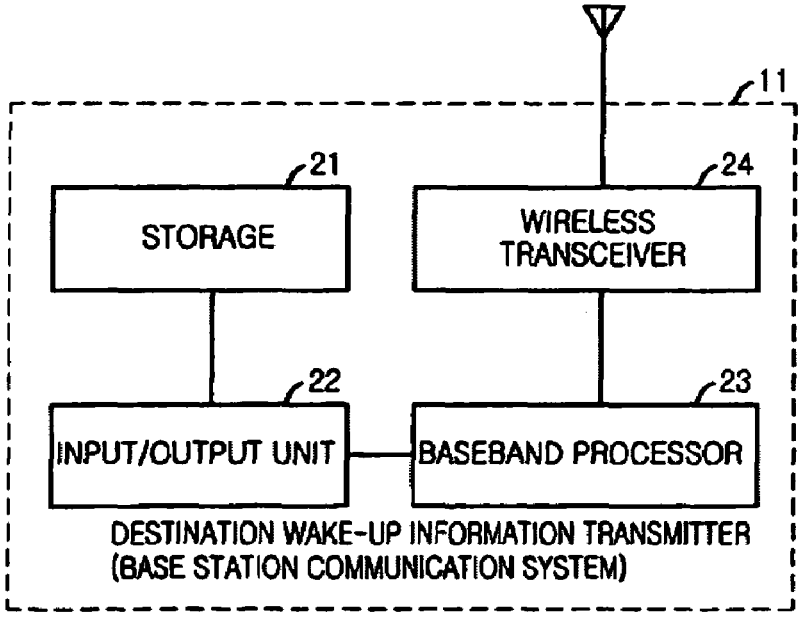
FIG. 2 is a block diagram showing a destination wake-up information transmitter using a satellite communication network in accordance with a preferred embodiment of the present invention.

FIG. 2 is a block diagram showing a destination wake-up information transmitter, i.e., a base station communication system, using a satellite communication network in accordance with a preferred embodiment of the present invention.

The destination wake-up information transmitter 11 includes a storage 21, an input/output unit 22, a baseband processor 23 and a wireless transceiver 24.

As shown, the input/output block 22 receives the ticketing data from the reservation server and the ticketing server, stores them in the storage 21, and then reads the ticketing data from the storage 21 in a predetermined time or in response to a request of outside and transmits the ticketing data to the baseband processor 23. The baseband processor 23 converts the ticketing data transmitted from the input/output block 22 to a baseband signal, e.g., a passenger information frame. The wireless transceiver 24 converts the baseband signal transmitted from the base band processor 23 to a wireless signal and transmits the wireless signal to the destination wake-up information receiver 12 through an antenna and the communication satellite 13.

Figure 4:
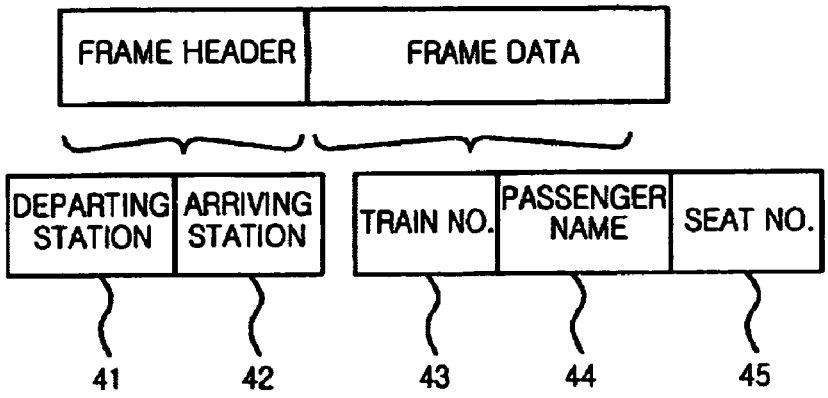
FIG. 4 is a block diagram showing a passenger information frame in accordance with a preferred embodiment of the present invention.

As shown in FIG. 4, the passenger information frame includes a frame header and a frame data. The frame header includes a departing station field 41 and an arriving station field 42. The frame data includes a train number field 43, a passenger name field 44 and a seat number field 45, wherein the passenger name field 44 is optional information.

The train number field 43 is used for determining whether the train and the ticketing data transmitted from the communication satellite 13 are matched. The arriving station field 42 and the seat number field 45 are used for detecting a seat by the destination wake-up information receiver 12, wherein a distance between a current position transmitted from the navigation satellite and destination of the seat is smaller than a predetermined distance.

Figure 3:
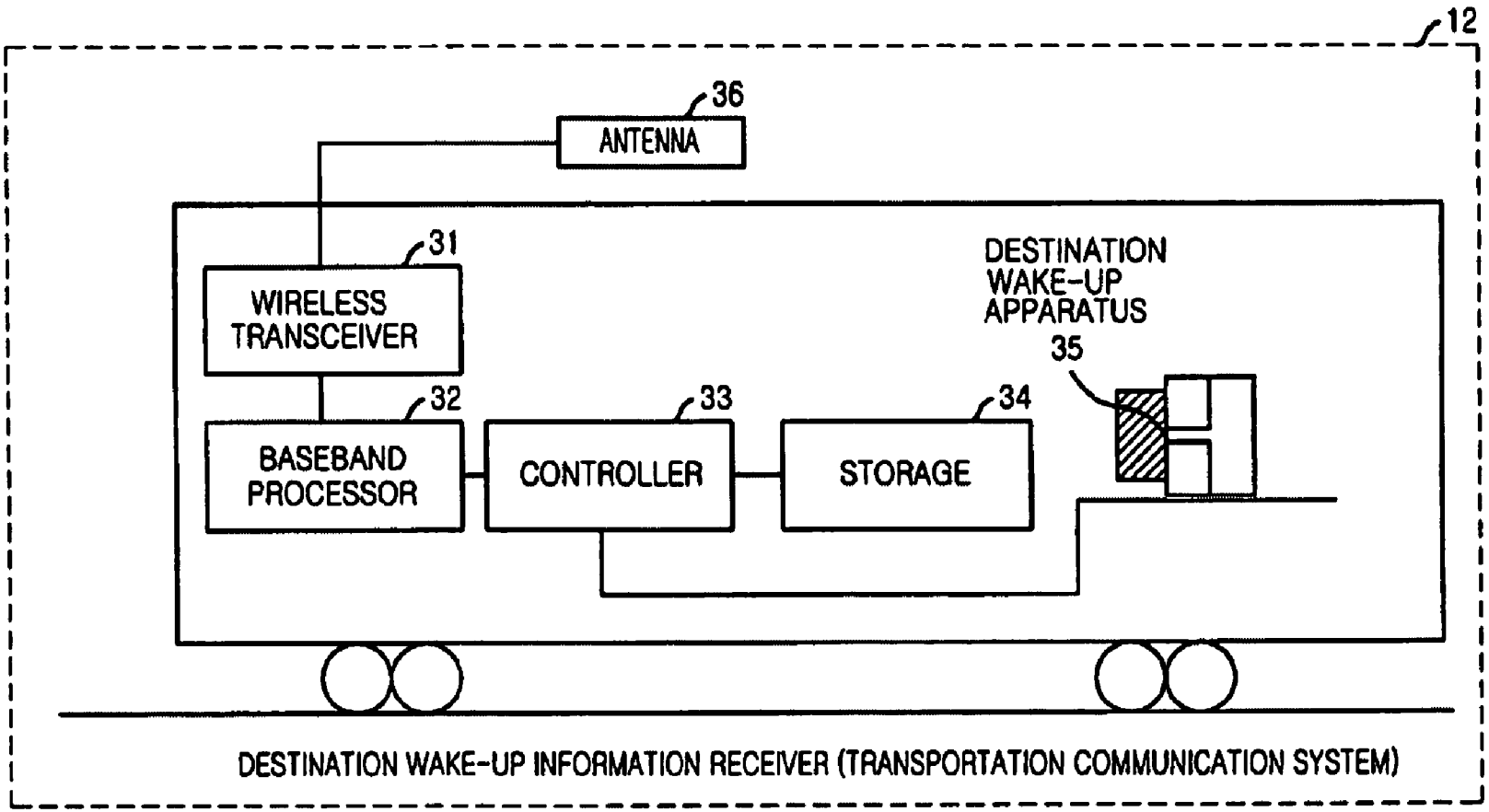
FIG. 3 is a block diagram showing a destination wake-up information receiver using a satellite communication network in accordance with a preferred embodiment of the present invention.

FIG. 3 is a block diagram showing a destination wake-up information receiver, using a satellite communication network in accordance with a preferred embodiment of the present invention.

As shown, the destination wake-up information receiver, i.e., the transportation communication system 12, includes a wireless transceiver 31, a baseband processor 32, a controller 33, a storage 34, a destination wake-up apparatus 35 and an antenna 36.

The wireless transceiver 31 converts a wireless signal transmitted from the destination wake-up information transmitter 11 into a baseband signal, transmits the baseband signal to the baseband processor 32. The wireless transceiver 31 also converts the wireless signal including navigation data, e.g., position information transmitted from the navigation satellite into a baseband signal and transmits the baseband signal to the baseband processor 32.

The baseband processor 32 converts the baseband signal transmitted from the wireless transceiver 31 into the ticketing data or the navigation data and transmits it to the controller 33.

The controller 33 stores the ticketing data transmitted from the baseband processor 32 in the storage 34 and extracts position information from the navigation data transmitted from the baseband processor 32. Then, the controller 33 detects a seat to be informed the destination wake-up information by comparing the position information to the arriving station field 42, and operates the destination wake-up apparatus 35 of the detected seat.

The storage 34 stores the ticketing data based on control of the controller 33.

The destination wake-up apparatus 35 outputs a destination wake-up signal based on control of the controller 33.

Herein, the seat to be informed the destination wake-up information denotes a seat of which destination is close. In other words, a distance between destination station of the seat included in the ticketing data and position included in the position information is shorter than the predetermined distance.

Though there is one train and one seat in FIG. 3, the controller 33 controls a plurality of the seats included in a plurality of the trains.

Furthermore, the controller 33 stores the passenger get-off information in the storage 34 and transmits it to the destination wake-up information transmitter 11 through the baseband processor 32, the wireless transceiver 31, the antenna 36 and the communication satellite 13.

Figure 5:
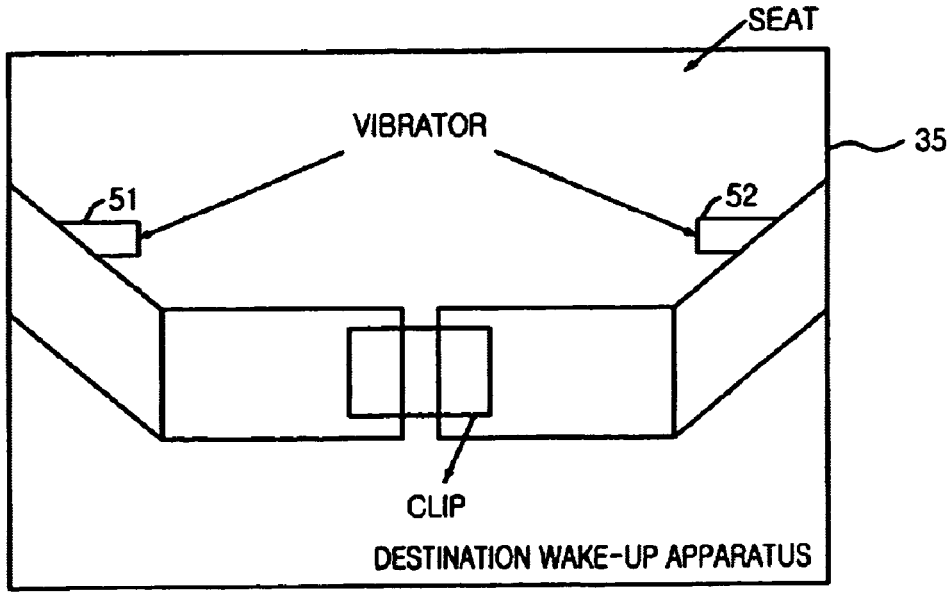
FIG. 5 is a block diagram showing a destination wake-up apparatus in accordance with a preferred embodiment of the present invention.

The destination wake-up apparatus 35 can be embodied as a seat belt provided with two vibrators 51 and 52 at each side as shown in FIG. 5. The seat belt is vibrated based on control of the controller 33 so that the passenger is recognized that the destination station is near. Herein, information broadcasting can be provided with the vibration.

An overall operation process will be described in detail with reference to FIG. 6.

Figure 6:
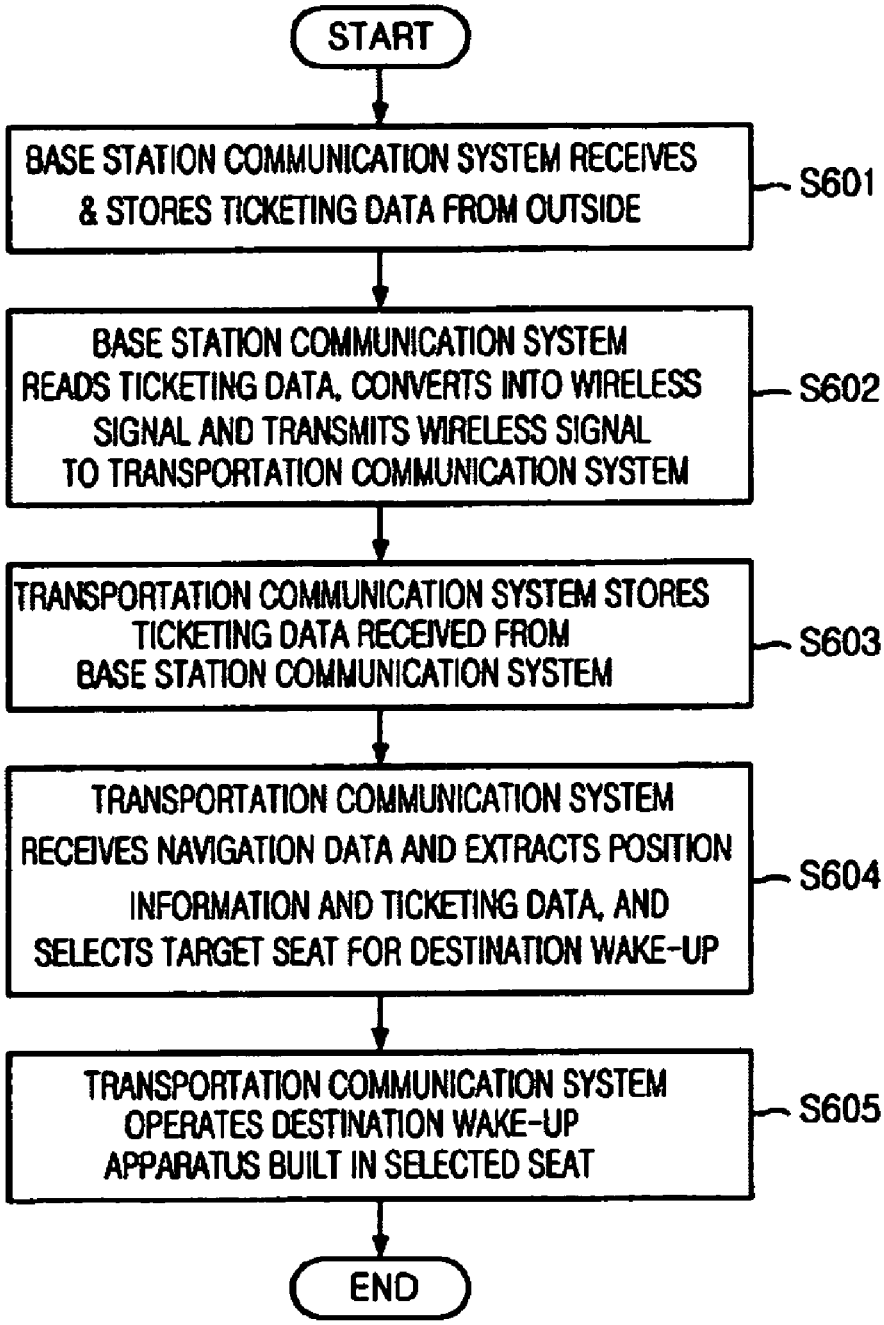
FIG. 6 is a flowchart showing a method for transmitting/receiving destination wake-up information using a satellite communication network in accordance with an embodiment.

FIG. 6 is a flowchart showing a method for transmitting/receiving destination wake-up information using a satellite communication network in accordance with an embodiment of the present invention.

The destination wake-up information transmitter 11 receives and stores the ticketing data from an outside, i.e., a reservation/ticketing server, at step S601.

According to a request or after a predetermined time, the destination wake-up information transmitter 11 reads the ticketing data, converts the ticketing data into a wireless signal and transmits the wireless signal to the destination wake-up information receiver 12 through the communication satellite 13 at step S602.

Then, the destination wake-up information receiver 12 stores the ticketing data received from the destination wake-up information transmitter 11 at step S603.

The destination wake-up information receiver 12 receives navigation data and extracts position information from the navigation data to thereby select a target seat for destination wake-up based on the position information and the ticketing data at step S604.

The destination wake-up information receiver 12 operates the destination wake-up apparatus 35 built in the target seat at step S605.

Then, the controller 33 recognizes that the passenger gets off the train, e.g., based on turn-off information of the destination wake-up apparatus. The controller 33 stores the passenger get-off information in the storage 34 and transmits it to the destination wake-up information transmitter 11.

The destination wake-up apparatus is described as the seat belt vibrating based on the control of the controller 33, various apparatuses such as an audio outputting apparatus, a lighting apparatus and a displaying apparatus can be embodied in accordance with the present invention.

As above-mentioned, the method of the present invention can be embodied as a program and stored in a computer-readable recording media, such as CD-ROM, RAM, floppy disk, hard disk, magneto-optical disk and the like.

The present invention can prevent the passenger to miss the destination by mistakes by operating the destination wake-up apparatus built in a seat when it is almost arrived at the destination.

The present invention informs the passenger of the destination by using the ticketing data that can be obtained when operating the transportation system such as a train and a bus. Therefore, the present invention can improves user convenience because the passenger does not need to input or setup information, e.g., the destination station additionally.

The present application contains subject matter related to Korean patent application No. 2003-88944, filed in the Korean Intellectual Property Office on Dec. 9, 2003, the entire contents of which being incorporated herein by reference.

While the present invention has been described with respect to certain preferred embodiments, it will be apparent to those skilled in the art that various changes and modifications may be made without departing from the scope of the invention as defined in the following claims.

What is claimed is:

1. An apparatus for receiving destination wake-up information through a satellite communication network, the apparatus comprising:

a wireless transceiving means for receiving a wireless signal from an apparatus for transmitting destination wake-up information through a communication satellite and a wireless signal including navigation data from a navigation satellite, converting the wireless signals into baseband signals and transmitting the baseband signals to a baseband processing means;

a baseband processing means for converting the baseband signal into ticketing data or the navigation data and transmitting the ticketing data or the navigation data;

a controlling means for receiving and storing the ticketing data from the baseband processing means, selecting a target seat to be informed destination wake-up information by comparing position information extracted from the navigation data to the ticketing data stored in the storing means, informing the target seat that destination is almost arrived by operating a destination wake-up apparatus and storing and transmitting passenger exit information based on turn-off information of the destination wake-up apparatus associated with an operating transportation means, wherein the exit information indicates that a passenger has exited the operating transportation means;

a storing means for storing the ticketing data; and a destination wake-up means for outputting a destination wake-up signal according to a control of the controlling means.

2. The apparatus as recited in claim 1, wherein the destination wake-up means is built in a seat of transportation as a seat belt provided with vibrators and generates vibration, to thereby inform the target seat of arrival at the destination.

3. An apparatus for receiving destination wake-up information through a satellite communication network, the apparatus comprising:

a wireless transceiving means for receiving a wireless signal from an apparatus for transmitting destination wake-up information through a communication satellite and a wireless signal including navigation data from a navigation satellite, converting the wireless signals into baseband signals and transmitting the baseband signals to a baseband processing means, the baseband signal comprising a passenger information frame having a train number field and a passenger name field;

a baseband processing means for converting the baseband signal into ticketing data or the navigation data and transmitting the ticketing data or the navigation data;

a controlling means for receiving and storing the ticketing data from the baseband processing means, selecting a target seat from a plurality of seats to be informed destination wake-up information by comparing position information extracted from the navigation data to the ticketing data stored in the storing means such that a selected target seat is one in which a distance between a current position extracted from the navigation data and a destination of the seat is less than a predetermined distance, informing the target seat that destination is almost arrived by operating a destination wake-up apparatus and storing and transmitting passenger exit information based on turn-off information of the destination wake-up apparatus associated with an operating transportation means, wherein the exit information indicates that a passenger has exited the operating transportation means;

a storing means for storing the ticketing data; and a destination wake-up means for outputting a destination wake-up signal according to a control of the controlling means.

* * * * *